US005975926A

United States Patent [19]

Uchiyama et al.

[11] Patent Number: 5,975,926

[45] Date of Patent: Nov. 2, 1999

[54] METAL SHIELD FOR A PLUG CONNECTION

[75] Inventors: Takehito Uchiyama; Yuji Watanabe; Shigeru Suzuki; Yoshinao Kobayashi, all of Mie, Japan

[73] Assignee: Sumitomo Wiring Systems, Ltd., Yokkaichi, Japan

[21] Appl. No.: 08/997,947

[22] Filed: Dec. 24, 1997

[30] Foreign Application Priority Data

Dec. 25, 1996 [JP] Japan ..... 8-345365

[51] Int. Cl.[6] ..... H01R 13/44

[52] U.S. Cl. ..... 439/126

[58] Field of Search ..... 439/125–128

[56] References Cited

U.S. PATENT DOCUMENTS

| | | | |
|---|---|---|---|
| 4,443,047 | 4/1984 | Hofmann | 439/128 |
| 5,283,499 | 2/1994 | Adam et al. | 439/126 |
| 5,348,486 | 9/1994 | Tura, Jr. et al. | 439/125 |

*Primary Examiner*—Gary F. Paumen
*Assistant Examiner*—Briggitte R Hammond
*Attorney, Agent, or Firm*—Greenblum & Bernstein, P.L.C.

[57] ABSTRACT

The plug connection comprises an elastomeric shroud having a plug-receiving portion through which is connected a spark plug comprising an hexagonal handling nut. A metal shield, comprising a top cover portion and two side-shield portions, covers the elastomeric shroud. When mounted, the side-shield portions surround the plug-receiving portions and form joint seam zones, each having a bottom end portion and a top portion. The bottom end portion of one seam zone includes an opening and the bottom end portion of the other seam zone includes a corresponding tab. The side-shield portions further comprise flanges. When the plug connection is connected to the spark plug, the flanges fit onto the hexagonal handling nut and the opening and tab are loosely fitted, so that the joint seam zones can be spaced apart. Preferably, the top portion contains protrusions provided on the side of the side-shield portions and a corresponding recess provided on the side of the top shield, these protrusions and recess fit together when the shield is mounted.

11 Claims, 7 Drawing Sheets

METAL SHIELD FOR A PLUG CONNECTION

BACKGROUND OF THE INVENTION

1. Field of the Invention

The present invention relates to the electrical connection of a high-voltage cable to a spark plug used in internal combustion engines of cars or other vehicles, stationary apparatus such as generators, or portable apparatus such as chain-saws, and the like. The invention more particularly concerns a shield or hood for covering the terminal portion of the high-voltage-cable.

2. Description of Background Information

FIGS. 1–7 show an example of the structure of a prior art plug connection device.

The device comprises a socket terminal 2 made of stainless steel or similar material and a shroud or boot 3 made of insulating elastic materials, such as silicone rubber or other elastomer, in which the socket terminal is contained. At one end of the socket terminal 2 a cable connecting portion 2*a* is provided where the high-voltage cable is crimped and electrically connected. The socket terminal 2 further has a plug-connecting portion 2*b* at the other end. This portion has an axis perpendicular to that of the cable connecting portion 2*a* and receives a bulb-like stud terminal 5*a* of a spark plug.

The insulating shroud 3 has a substantially L-shaped configuration, one branch of which forms a sleeve portion 3*a* into which the socket terminal 2 is received. The sleeve portion 3*a* defines a cable path-hole 3*b* through which the high-voltage cable is introduced. The other branch of the L-shaped shroud defines a tubular plug receiving portion 3*d* having a plug path-hole 3*c* and a closed end. The stud terminal 5*a* of the spark plug is guided through this path-hole 3*c* and inserted into the plug connecting portion 2*b*.

The shroud 3 is enclosed in a metal cover 7. As shown in FIG. 2, the metal cover 7 is prepared by stamping out an appropriate shape from a metal plate, i.e., an aluminum sheet, and folding or bending it. The central part of the metal plate corresponds to the top-cover portion 7*a* while the side parts flanking the top-cover portion 7*a* correspond to laterally-defining side cover portions 7*b*, 7*c* which are substantially symmetrical. The metal cover 7 is shaped by folding or bending these parts.

With a metal cover 7 as shown in FIGS. 1–5 and 7, the outer circular surface of the plug receiving portion 3*d* is covered with a pair of side-cover portions 7*b*, 7*c* which extend along the guiding direction of the stud terminal 5*a*. When the sidecover portions 7*b*, 7*c* are folded and shaped, they form joint seam zones 7*d*, 7*e*. One of them is provided with a recess 7*f*, while the other is provided with a complementary shaped tab 7*g*. Thus, the tab 7*g* is fitted into the recess, as shown in FIG. 5.

In this construction, the upper and lateral parts of the socket terminal 3*a* are shielded respectively with a top cover 7*a* and side-cover portions 7*b*, 7*c*. The side-cover portions are provided with corresponding fitting flanges 7*h*, 7*i* depending from the bottom end thereof. Normally the spark plug comprises a stud terminal 5*a*, a metallic stud cover 5*b* and a hexagonal handling nut 5*c* therebetween. When the stud terminal is inserted through the plug path-hole 3*c* and connected to the socket terminal 2, the hexagonal handling nut 5*c* is fitted between the flanges 7*h*, 7*i*.

As shown in FIG. 1, a dielectric sheet 10 is interposed between the external surface of the elastomeric shroud 3 and the internal surface of the metal shield 7.

When the spark plug 5 is mounted onto a side of an engine 9 and the stud terminal 5*a* is connected to the plug-connecting portion 2*b* of the plug connection, the flanges 7*h*, 7*i* of the metal cover 7 are put into contact with an outer surface of the hexagonal handling nut 5*c*. This cover 7 prevents thermal deteriorations of the elastomeric shroud 3. Such a type of flanged metal cover is described, for instance, in U.S. Pat. No. 5,348,486, issued on Sep. 20, 1994.

With the structure of the prior art cover, each flange 7*h*, 7*i* is put into contact with the hexagonal handling nut 5*c* and thus is electrically grounded to the side of the engine 9. The heat released is also led away. For this purpose, each flange 7*h*, 7*i* has to be in contact with an outer surface of the hexagonal handling nut 5*c*.

As mentioned above, the side-cover portions 7*b*, 7*c* have joint seam zones 7*d*, 7*e* correspondingly provided with a recess 7*f* and a tab 7*g*. The recess and the tab are interlocked by mutual engagement so that both joint seam zones 7*d*, 7*e* are firmly closed and resist a tangential opening force. Also, the diametric distance L separating both flanges 7*h*, 7*i* corresponds roughly to the diameter M of the tangent circle of the hexagonal handling nut 5*c*.

In this structure, the diametric distance L between the flanges 7*h* and 7*i* is determined solely on the basis of the diameter M of the tangent circle. Thus, when manufacturing, a corresponding dimensional precision is needed to fix that distance.

When the diametrical distance L is shorter than the diameter M of the tangent circle, the two flanges 7*h* and 7*i* may not fit properly onto the hexagonal handling nut 5*c*. Consequently, the elastomeric shroud 3 cannot be fitted smoothly over the spark plug 5, leading to a low work efficiency.

On the contrary, when the diametrical distance L is longer than the diameter M, the fit is loose and easily jolted. Consequently, engine 9 may shake the metal cover 7 off the hexagonal handling nut 5*c*, and further increase the misfitting. Sometimes, the metal cover 7 may separate from the elastomeric shroud 3.

Further, the metal cover 7 cannot exert the force necessary to fix the elastomeric shroud 3 onto the spark plug 5. Vibrations then increase the abrasion between the stud terminal 5*a* of the spark plug and the plug-connecting portion 2*b*, thus disrupting the electrical contact.

SUMMARY OF THE INVENTION

A purpose of the present invention is to provide a terminal shield structure of a high-voltage cable which improves fitting handling and renders the structure more resistant to fretting or abrasion.

To this end, a first embodiment of the present invention provides a metal shield for the plug connection for a spark plug comprising a top shield portion having an end zone and a pair of partly circular side-shield portions depending from the top shield portion and partly connected with respect to each other by fixing elements, thereby forming joint seam zones. These joint seam zones have a top portion near the end zone of the top shield portion and a bottom portion. The flanges are also provided depending from the side-shield portions and fitting onto the spark plug. The fixing elements comprise a tab formed at one of the joint seam zones and an opening formed adjacent the other, whereby, when the tab and opening are fitted together. The opening allows the tab to shift therein so as to allow the joint seam zones to be spaced apart to a greater or lesser extend. Additionally, the metal shield may be formed from an elastically deformable metal such that a restoring force is exerted on the spark plug by the flanges of the side-shield portions.

Preferably, the fixing elements are located near the bottom portion of the joint seam zones.

The end zone of the top shield portion may comprise a recess and the top zone of each joint seam zone may comprise corresponding protrusions. The recess and protrusions may then be fitted together in the connected state.

In a second embodiment, the metal shield may also comprise joint seam zones provided with elastically closing elements. Preferably, the elastically closing elements comprise a plurality of spaced apart pins outwardly projecting from the joint seam zones, alternately installed on opposite sides thereof, and an elongate elastic material intertwined therebetween.

BRIEF DESCRIPTION OF THE FIGURES

The above and other features and advantages of the present invention will become apparent from the following description of the preferred embodiments, given as a non-limiting example, with reference to the accompanying drawings, in which.

DETAILED DESCRIPTION OF THE PREFERRED EMBODIMENTS

Figure 8:
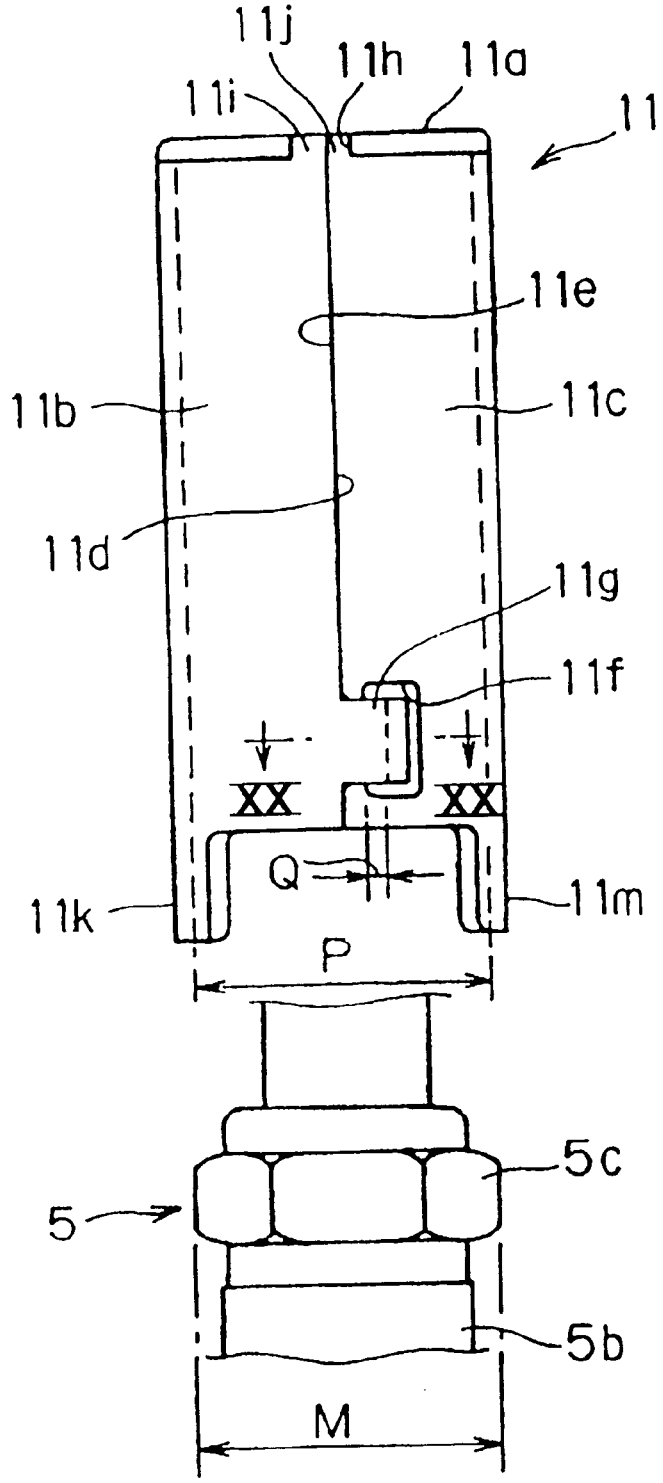
FIG. 8 shows a rear elevational view of a metal shield according to a first embodiment of the invention, together with a part of a spark plug.

The embodiments of the present invention will be explained on the basis of the following figures. In the first embodiment as depicted in FIG. 8, the metal shield 11 is formed by stamping out an appropriately shaped flat sheet or a plate of metal and by folding or bending that plate. This sheet or plate may be made of an elastically deformable metal, such as aluminum or a similar material.

Figure 9:
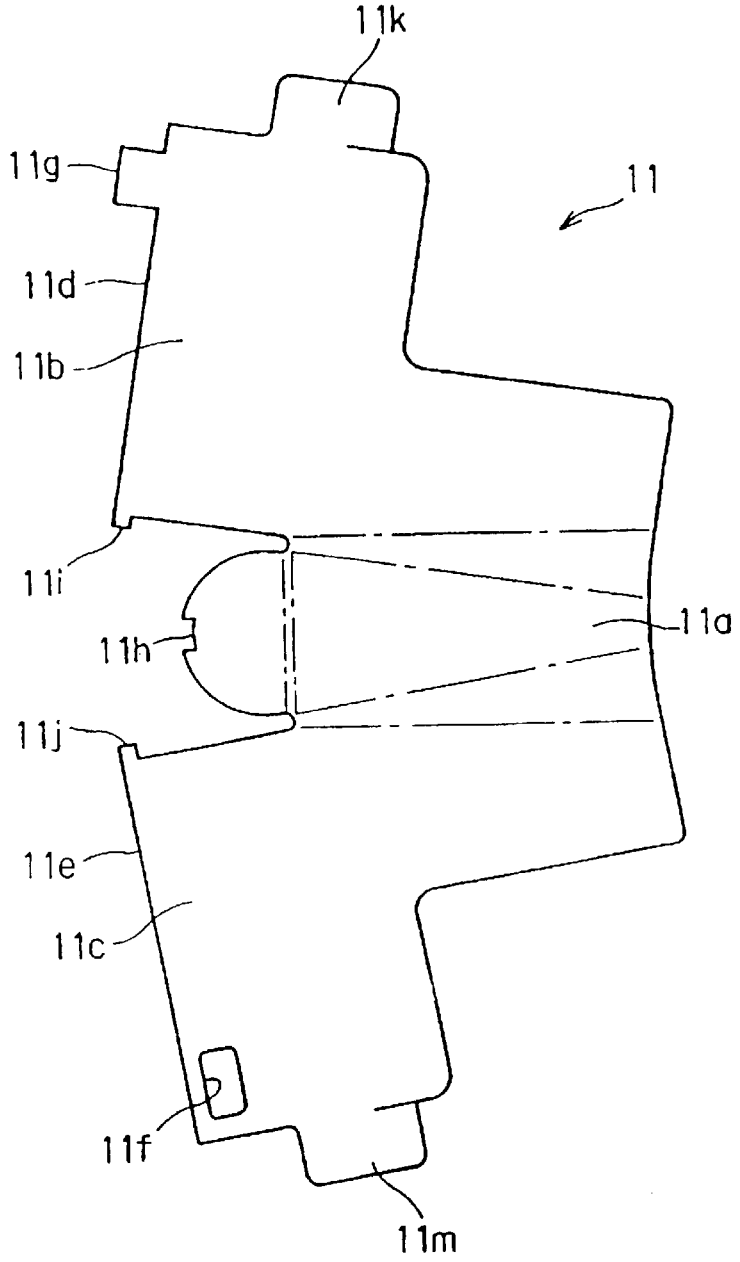
FIG. 9 shows a developed plan view of the metal shield of the present invention.

As shown in FIG. 9, the shaped plate comprises a top shield portion 11*a* located at a central zone and substantially symmetric side-shield portions 11*b* and 11*c* flanking the top shield portion 11*a*. The metal shield 11 is formed by folding along lines separating these portions.

As is in the prior art, the elastomeric shroud or boot 3 houses the socket terminal 2 which is connected with the end part of a high-voltage cable 1. This elastomeric shroud is then covered with an insulating sheet 10.

In the above-mentioned metal shield 11, as is in the prior art, a pair of side-shield portions 11*b*, 11*c* extends along the insertion axis of the stud terminal 5*a* and covers the outer circular face of the plug-receiving portion 3*d*. The side-shield portions 11*b*, 11*c* are then curved and joined together, thereby forming joint seam zones 11*d*, 11*e*. According to the invention, one of the joint seam zones 11*e* is provided with an opening 11*f*, whereas the other 11*d* is provided with a tab 11*g*. The opening 11*f* is provided with ample space, so that the tab 11*g* is fitted thereinto with some play.

Figure 10:
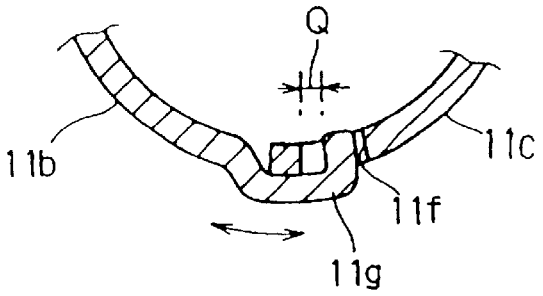
FIG. 10 shows a part of cross-sectional view of FIG. 8 taken along the line X—X of FIG. 8.

The fact that the opening 11*f* and the tab 11*g* are fitted with some play, as shown in FIGS. 8 and 10, enables the joint seam zones 11*d*, 11*e* to be spaced apart. Further, the tab and opening are located near the insertion side of the stud terminal 5*a*, i.e., near the bottom side of the plug connection as shown in FIG. 8.

Figure 12:
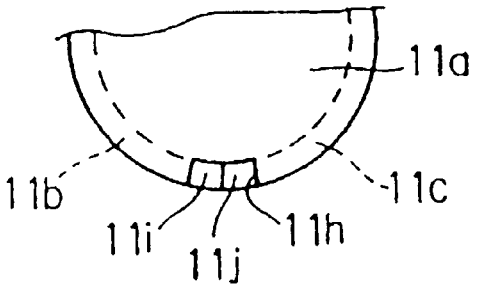
FIG. 12 shows a partial top plan view of the metal shield of the invention.

Moreover, the top shield portion 11*a* is provided with a recess 11*h* at a position corresponding to the joint seam zones 11*d*, 11*e* and distal to the tab and opening (top of the plug connection in FIG. 8). Correspondingly, the joint seam zones 11*d*, 11*e* are provided with protrusions 11*i*, 11*j* at their top part. The protrusions 11*i*, 11*j* are then fitted into the recess 11*h*, as shown in FIG. 12.

As shown in FIGS. 8 and 9, the side-shield portions 11*b*, 11*c* respectively comprise a flange 11*k*, 11*m* at their bottom end, as is in the prior art. When the stud terminal 5*a* of the spark plug 5 is introduced into the plug path-hole 3*c* and connected to the socket terminal, the flanges 11*k* and 11*m* sandwich the hexagonal handling nut 5*c* mounted on the core metal 5*b* of the spark plug 5.

According to the construction of the invention, the two joint seam zones 11*d*, 11*e* of the side-shield portions 11*b*, 11*c* are fitted with ample play through the opening 11*f* and tab 11*g*, and can thus be easily spaced apart. Accordingly, the diametrical distance P between the two flanges 11*k*, 11*m* can be varied by enlarging the opening-and-tab fixture. When the distance P between the two flanges or the diameter M of outer tangent circle of the hexagonal handling nut 5*c* fluctuates with manufacturing conditions, it can easily be adjusted by spacing the joint seam zones 11*d*, 11*e* apart. The task of fitting these portions is thus facilitated.

Accordingly, when the distance P between the two flanges 11*k*, 11*m* is initially set up to be a little shorter than the diameter M, dimensional precision between P and M is not stringently required. Consequently, manufacturing becomes easier and the related costs may be reduced.

The tab 11*g* is inserted into the opening 11*f* with a certain play and can be shifted therein. For the task of fitting, the sum of the allowable spacing shift Q and the distance P is preferably set to be greater than the diameter M.

In the above structure, the stud terminal 5*a* of the spark plug 5 is passed through the plug path-hole 3*c* of the plug-receiving portion 3*d* and connected to the cable-connecting portion 2*a* of the socket terminal. Then, by setting the distance P to be somewhat shorter than the diameter M, the flanges 11*k*, 11*m* are fitted onto faces of the hexagonal handling nut 5*c* in slightly enlarged state. Thus, the latter is held by the elastic return force exerted by the flanges 11*k*, 11*m*. In this way, the relative shift between the socket terminal 2 and the stud terminal 5*a*, caused by vibrations coming from the engine side, is efficiently reduced. Consequently, not only the resistance of the plug connection against vibrations is improved, but also, wear due to fretting between the socket terminal 2 and the stud terminal 5*a* is efficiently prevented.

Figure 1:
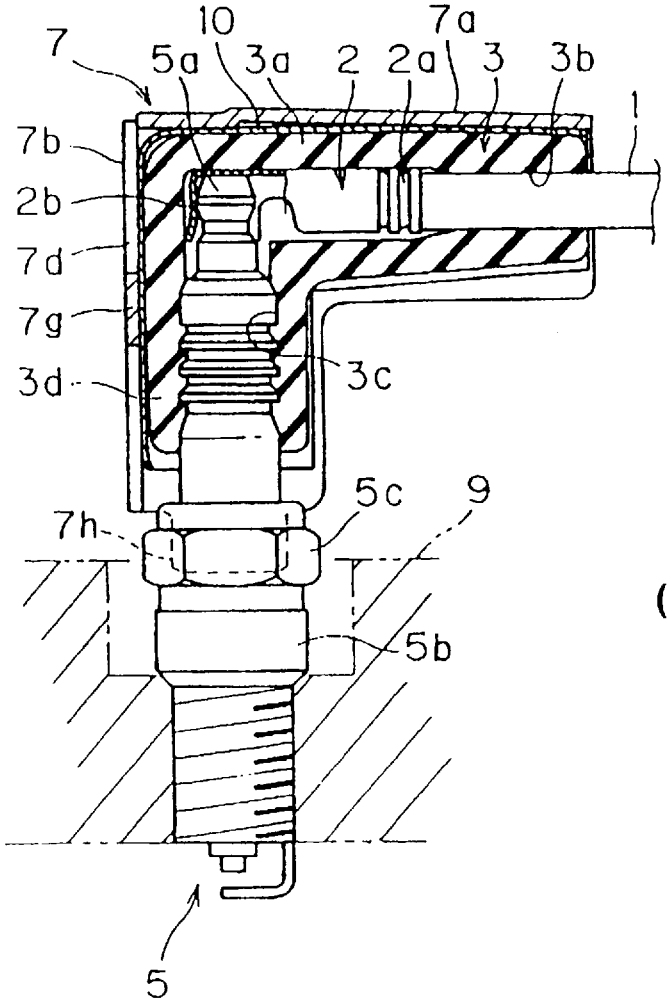
FIG.1 (PRIOR ART)
FIG. 1 shows a side-elevational view of a prior art plug connection, partly in cross section.
Figure 3:
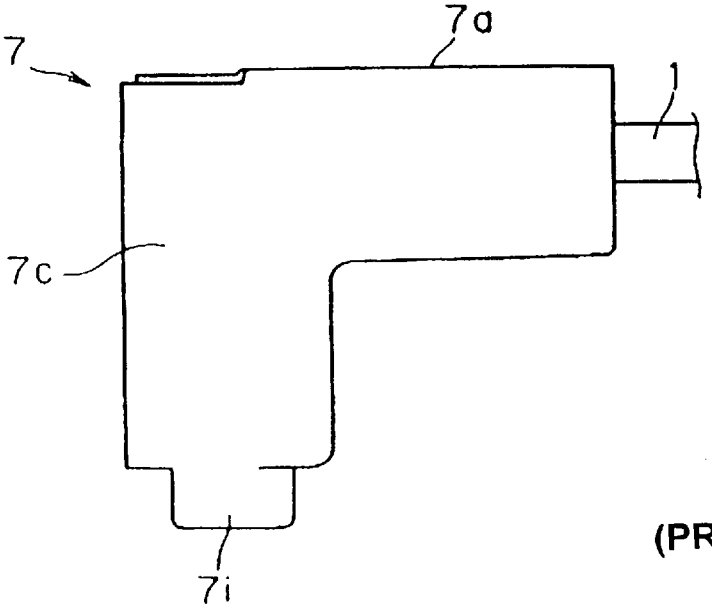
FIG.3 (PRIOR ART)
FIG. 3 shows a side-elevational view of a prior art metal shield, when partly mounted.
Figure 2:
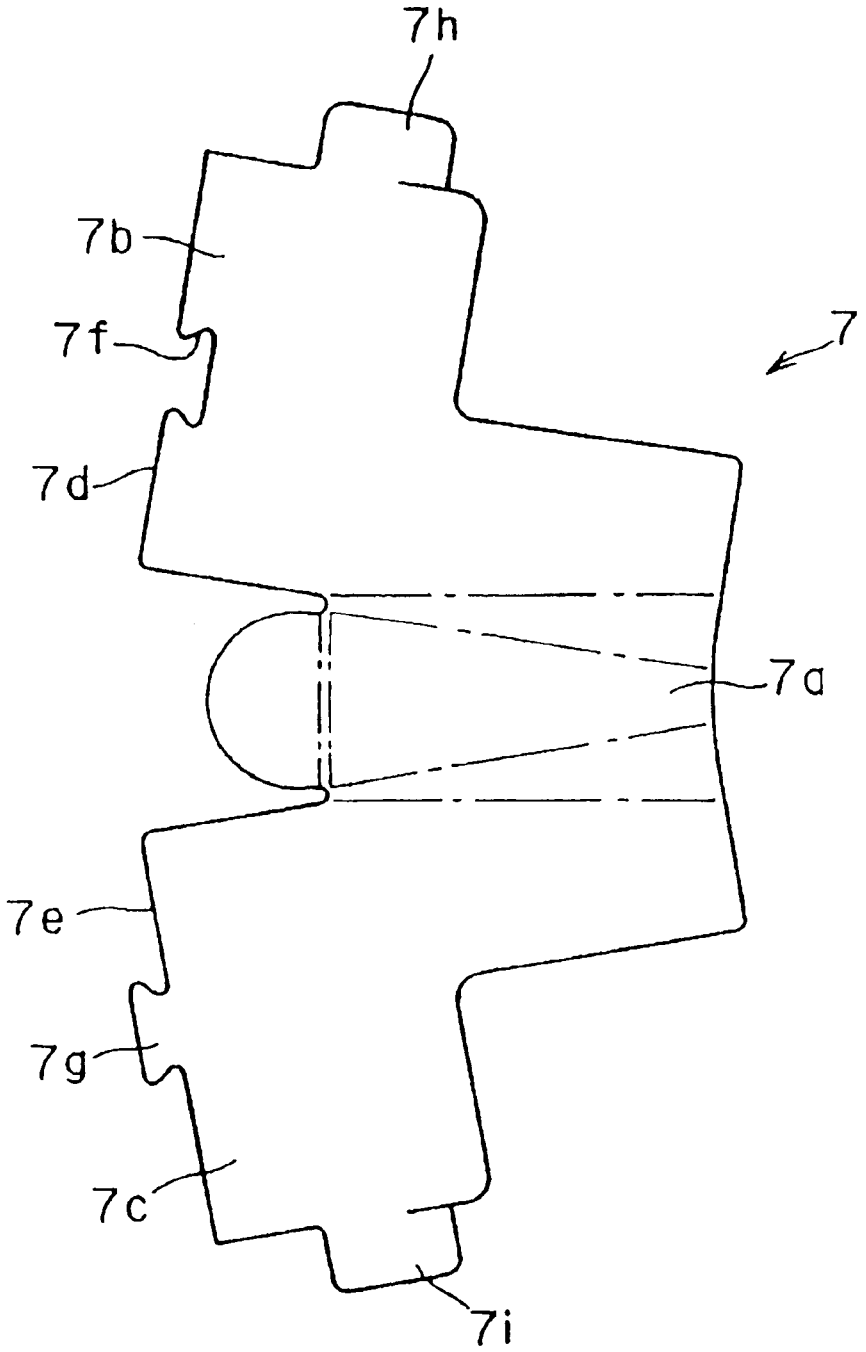
FIG.2 (PRIOR ART)
FIG. 2 shows a developed plan view of a prior art metal shield.
Figure 4:
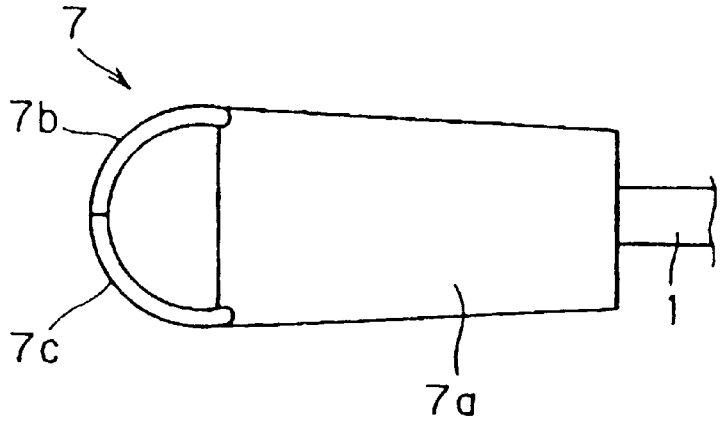
FIG.4 (PRIOR ART)
FIG. 4 shows a top plan view of the metal shield of FIG. 3, when it is mounted.
Figure 5:
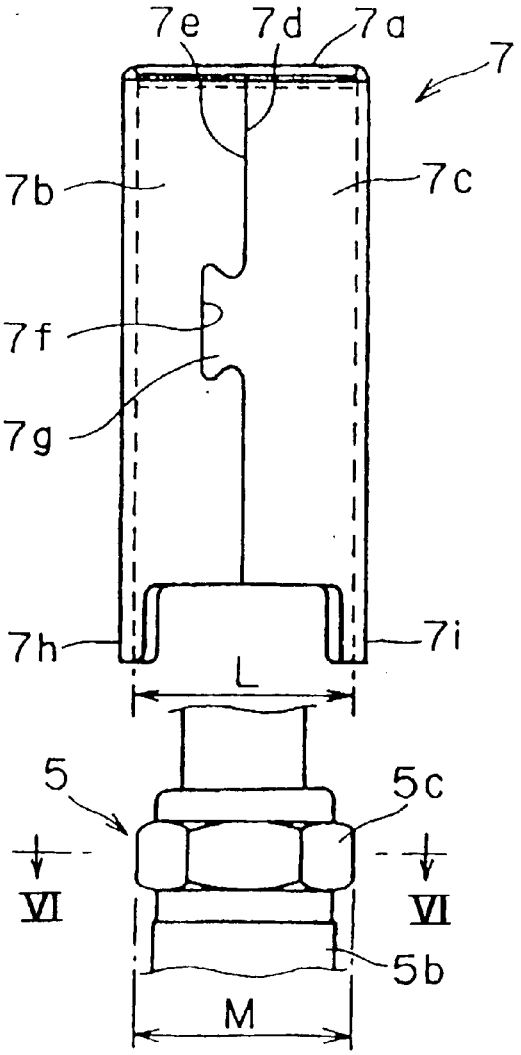
FIG.5 (PRIOR ART)
FIG. 5 shows a rear elevational view of the metal shield of FIG. 4.
Figure 6:
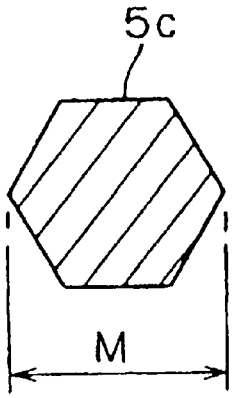
FIG.6 (PRIOR ART)
FIG. 6 shows a cross-sectional view of the hexagonal handling nut taken along the line VI—VI of FIG. 5.
Figure 7:
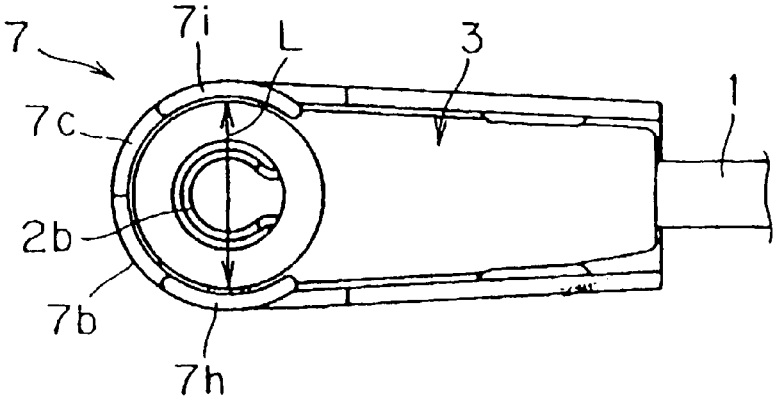
FIG.7 (PRIOR ART)
FIG. 7 shows a bottom plan view of the prior art plug connection.

Further, the opening 11*f* and the tab 11*g*, both designed for a loose fit, are provided near the insertion side of the stud terminal 5*a*, i.e., near the bottom end of the plug connection in FIG. 1. Therefore, the spacing between the flanges 11*k*, 11*m* can be expanded easily during the insertion of the plug. This configuration also facilitates the installation of the shield.

The joint seam zones 11*d*, 11*e* of the side-shield portions 11*b*, 11*c* are provided with the protrusions 11*i*, 11*j* at the top end thereof, whereas an end zone of the top portion 11*a* of the shield is provided with a corresponding recess 11*h*. When the protrusions and the recess are fitted together, loosening of the upper portion is efficiently avoided. The shield is thus properly secured to the shroud.

As shown in FIG. 10, the tab 11*g* may be fitted loosely into the opening from outside and around the side shield portion 11*c*.

Figure 11:
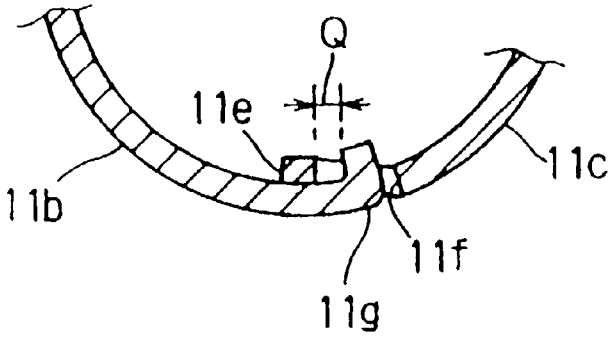
FIG. 11 shows a variant of the metal shield of FIG. 10.

Alternatively, as shown in FIG. 11, the joint seam zone 11*e* of the side-shield portion 11*c* may be folded towards the inside to receive the tab.

Figure 13:
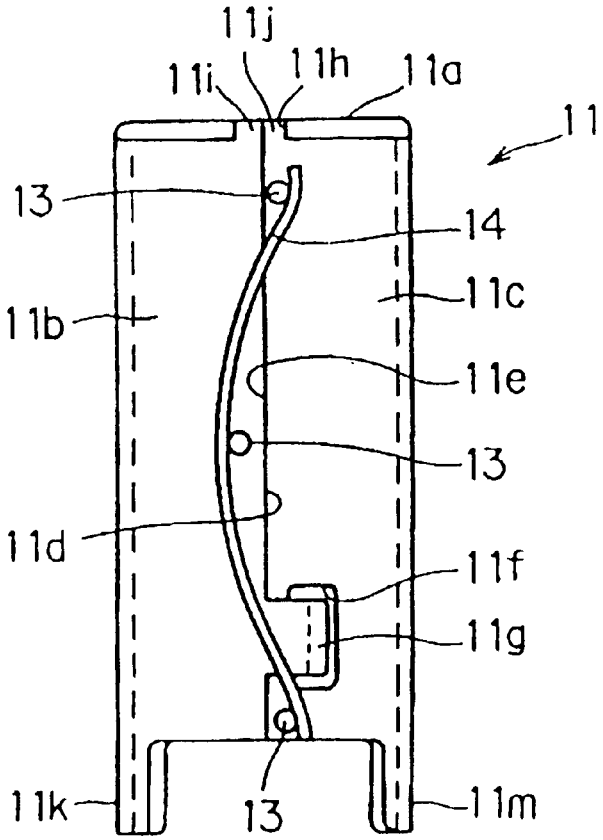
FIG. 13 shows a rear elevational-view of a second embodiment of the present invention.

FIG. 13 shows a second embodiment of the present invention, where the same reference numbers are used as in the above embodiments.

In this embodiment, the joint seam zones 11*d*, 11*e* of the side-shield portions 11*b* and 11*c* are provided with a suitable number of pins 13 of their outer surface. These pins 13 are then equipped with a pressing device 14 made of an elongate elastic material such as piano wire that confers a closing force to the zones 11*d*, 11*e*.

Preferably, three pins are arranged with one pin at the center of one seam zone and with one pin at the opposed end portions of the other joint seam zone.

According to this embodiment, the fit between the metal shield and the hexagonal handling nut 5*c* is enhanced not only due to the restoring force of the enlarged flanges 11*k*, 11*m*, but also by the containing force of the elongate elastic material 14.

When the sum of the distance P and the allowable enlargement shift Q is shorter than the diameter M of the tangent circle, not only the flanges 11*k*, 11*m*, but also the metal shield itself, are elastically deformed. This deformation exerts a strong restoring force onto the hexagonal handling nut 5*c*, even without the use of the elongate elastic material 14. Moreover, as the allowable enlargement shift Q is set up to an arbitrary value, an appropriate fitting force may be arranged according to requirements.

In the above embodiment, the opening 11*f* and the tab 11*g* are provided near the bottom of the joint seam zones 11*d*, 11*e*. However, they may be provided on the upper or central portion thereof. There is in fact no particular limitation as to their position. Further the shield need not include the recess 11*h* and the projections 11*i* and 11*j*.

Further, the structure or shape of an elastomeric shroud 3 covered by the metal shield is not limited to that described in the above embodiments.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 8-345365, filed on Dec. 25, 1996, which is herein expressly incorporated by reference in its entirety.

What is claimed:

1. A metal shield for a plug connection to a spark plug, said shield comprising:

a top shield portion having an end zone;

a pair of partly circular side-shield portions depending from the top shield portion and being partly connected with respect to each other by fixing elements, thereby forming joint seam zones having a top portion near said end zone of said top shield portion and a bottom portion, wherein said end zone of said top shield portion includes a recess, and said top portion of each said joint seam zone comprises corresponding protrusions, whereby said recess and protrusions are fitted together in a connected condition; and flanges depending from said side-shield portions and fitting onto said spark plug, said fixing elements comprising a tab formed at one of said joint seam zones and an opening formed adjacent the other of said joint seam zones, said opening being dimensioned to loosely receive said tab therein, and said fixing elements being located near said bottom portion of said joint seam zones, whereby when said tab and opening are fitted together, said opening allows said tab to shift therein so as to allow said joint seam zones, at said bottom portions thereof, to be spaced apart to a greater or lesser extent.

2. The metal shield according to claim 1, wherein said end zone of said top shield portion comprises a recess and said top portion of each said joint seam zone comprises corresponding protrusions, whereby said recess and said protrusions are fitted together in the connected condition.

3. The metal shield according to claim 1, wherein said joint seam zones are provided with elastically closing elements.

4. The metal shield according to claim 1, wherein said joint seam zones are provided with elastically closing elements.

5. The metal shield according to claim 1, wherein said joint seam zones are provided with elastically closing elements.

6. The metal shield according to claim 1, wherein the metal shield is formed from an elastically deformable metal such that a restoring force is exerted on the spark plug by the flanges of the side-shield portions.

7. The metal shield according to claim 2, wherein said joint seam zones are provided with elastically closing elements.

8. The metal shield according to claim 3, wherein said elastically closing elements comprise a plurality of spaced apart pins outwardly projecting from said joint seam zones and alternately installed on opposite sides thereof, and an elongate elastic material intertwined therebetween.

9. The metal shield according to claim 4, wherein said elastically closing elements comprise a plurality of spaced apart pins outwardly projecting from said joint seam zones and alternately installed on opposite sides thereof, and an elongate elastic material interwined therebetween.

10. The metal shield according to claim 5, wherein said elastically closing elements comprise a plurality of spaced apart pins outwardly projecting from said joint seam zones and alternately installed on opposite sides thereof, and an elongate elastic material interwined therebetween.

11. The metal shield according to claim 7, wherein said elastically closing elements comprise a plurality of spaced apart pins outwardly projecting from said joint seam zones and alternately installed on opposite sides thereof, and an elongate elastic material interwined therebetween.

* * * * *

UNITED STATES PATENT AND TRADEMARK OFFICE

CERTIFICATE OF CORRECTION

PATENT NO. : 5,975,926

DATED : November 2, 1999

INVENTOR(S) : T. UCHIYAMA et al.

It is certified that error appears in the above-identified patent and that said Letters Patent is hereby corrected as shown below:

At column 6, line 57 (claim 4, line 1) of the printed patent, "1" should be ---6---.

At column 6, lines 60-62 of the printed patent, Claim 5 should be cancelled.

At column 7, line 13 (claim 9, line 5) of the printed patent, "interwined" should be ---intertwined---.

At column 8, lines 1-6 of the printed patent, Claim 10 should be cancelled.

At column 8, line 10 (claim 11, line 5) of the printed patent, "interwined" should be ---intertwined---.

Signed and Sealed this

Third Day of April, 2001

*Attest:*

Nicholas P. Godici

NICHOLAS P. GODICI

*Attesting Officer*

*Acting Director of the United States Patent and Trademark Office*